US009085137B2

(12) United States Patent
Bonino et al.

(10) Patent No.: US 9,085,137 B2
(45) Date of Patent: Jul. 21, 2015

(54) METHOD AND APPARATUS TO REDUCE SETTLING OF MAGNETIC PARTICLES IN MAGNETIC INK

(75) Inventors: Paul S. Bonino, Ontario, NY (US); Timothy P. Foley, Marion, NY (US)

(73) Assignee: Xerox Corporation, Norwalk, CT (US)

( * ) Notice: Subject to any disclaimer, the term of this patent is extended or adjusted under 35 U.S.C. 154(b) by 56 days.

(21) Appl. No.: 13/603,551

(22) Filed: Sep. 5, 2012

(65) Prior Publication Data

US 2014/0063100 A1 Mar. 6, 2014

(51) Int. Cl.

| | |
|---|---|
| ***B41J 29/38*** | (2006.01) |
| ***B41J 2/045*** | (2006.01) |
| ***G03G 15/10*** | (2006.01) |

(52) U.S. Cl.

CPC ..... *B41J 2/04586* (2013.01); *B41J 2/04513* (2013.01); *G03G 15/10* (2013.01); *B41J 2202/04* (2013.01); *G03G 2215/0013* (2013.01)

(58) Field of Classification Search

USPC ..... 347/5, 9–14

See application file for complete search history.

(56) References Cited

U.S. PATENT DOCUMENTS

| | | | | |
|---|---|---|---|---|
| 4,812,856 | A | 3/1989 | Wallace | |
| 4,814,786 | A * | 3/1989 | Hoisington et al. | 347/88 |
| 2007/0057983 | A1 * | 3/2007 | Kawaguchi et al. | 347/9 |
| 2009/0213160 | A1 * | 8/2009 | Murai | 347/14 |
| 2010/0289844 | A1 * | 11/2010 | Seibt | 347/15 |
| 2011/0115844 | A1 * | 5/2011 | Ozawa | 347/28 |
| 2012/0162330 | A1 * | 6/2012 | Iftime et al. | 347/88 |

* cited by examiner

*Primary Examiner* — Geoffrey Mruk

*Assistant Examiner* — Scott A Richmond

(74) *Attorney, Agent, or Firm* — Maginot, Moore & Beck LLP

(57) ABSTRACT

An inkjet printer is configured to reduce the settling of magnetic particles in magnetic ink. The inkjet printer is configured to eject magnetic ink and black ink in areas where the corresponding image data only has black ink pixels. The printing of the magnetic ink in the black ink areas helps prevent the magnetic particles in the magnetic ink from settling.

8 Claims, 3 Drawing Sheets

METHOD AND APPARATUS TO REDUCE SETTLING OF MAGNETIC PARTICLES IN MAGNETIC INK

TECHNICAL FIELD

This disclosure relates generally to inkjet printers, and more particularly to inkjet printers that produce ink images with magnetic ink.

BACKGROUND

In general, inkjet printers include at least one printhead that ejects drops of liquid ink onto a surface of an image receiving member. In an indirect or offset printer, the inkjets eject ink onto the surface of a rotating image receiving member, such as a rotating metal drum or endless belt, before the ink image is transferred to print media. In a direct printer, the inkjets eject ink directly onto print media, which may be in sheet or continuous web form. A phase change inkjet printer employs phase change inks that are solid at ambient temperature, but transition to a liquid phase at an elevated temperature. Once the melted ink is ejected onto the media or image receiving member, depending upon the type of printer, the ink droplets quickly solidify to form an ink image.

Inkjet printers are used to print a wide range of documents using various types and colors of ink. Some printed documents are read by both humans and machines. For example, a check includes printed text that is both human readable and readable by automated check processing equipment. Check processing machines use Magnetic Ink Character Recognition (MICR) to identify printed characters in a check, such as routing and account numbers, quickly and accurately. The magnetic ink readable by MICR machines includes a suspension of magnetic particles, such as iron oxide, which are detectable using a magnetic field. The use of MICR printing is widespread and enables automated processing of checks and other documents even when the printed magnetic ink characters are visually obscured by stamps or other overprinting. Automated check processing machines perform high-speed character recognition using printed magnetic ink characters to identify account and routing numbers. While check processing is one application of magnetic ink printing, magnetic inks can be incorporated in a wide range of printed documents and can be used in conjunction with non-magnetic inks as well.

Solid ink printers receive ink in a solid form, sometimes known as solid ink sticks. The solid ink sticks are typically inserted in an ink loader for the printer and are moved by a feed mechanism and/or gravity toward a heater plate. The heater plate melts the solid ink impinging on the plate into a liquid that is delivered to a melt reservoir. The melt reservoir maintains the ink in a melted state and delivers the ink to a printhead for ejection onto an image receiving surface.

In MICR solid ink, magnetic particles are suspended in a phase change ink. When MICR solid ink is melted and in a liquid state, the metal particles are pulled downwardly by gravity and can collect in the lower regions of melted ink containers and passageways in a printer. The metal particles settling out of the ink can degrade the uniform distribution of magnetic particles in the ink, which can cause the printed ink to be outside the readable limits for MICR readers. Characters printed with the non-uniform ink can be difficult for MICR readers to recognize. Thus, a need exists for devices and methods that help maintain a uniform distribution of magnetic particles in phase change magnetic ink as the ink is used in an inkjet printer.

SUMMARY

In one embodiment a method of printing reduces the degradation of marking material stored in a printer. The method includes receiving image data corresponding to an image having at least one area in which only pixels of a second marking material are to be printed; operating a first marking station to print a first marking material in the at least one area in which only pixels of the second marking material are to be printed to reduce degradation of the first marking material stored in a printer; and operating a second marking station to print the second marking material in the at least one area in which only the second marking material is to be printed.

A printer implements the method to reduce degradation of marking material stored in the printer. The printer includes a first marking station configured to print a first marking material, a second marking station configured to print a second marking material, and a controller. The controller is operatively connected to the first and second marking stations and is configured to receive image data corresponding to an image having at least one area in which only the second marking material is to be printed. The controller is further configured to operate the first marking station to print the first marking material in the at least one area in which only the second marking material is to be printed to reduce degradation of the first marking material stored in the printer, and to operate the second marking station to print the second marking material in the at least one area in which only the second marking material is to be printed.

DETAILED DESCRIPTION

Figure 1:
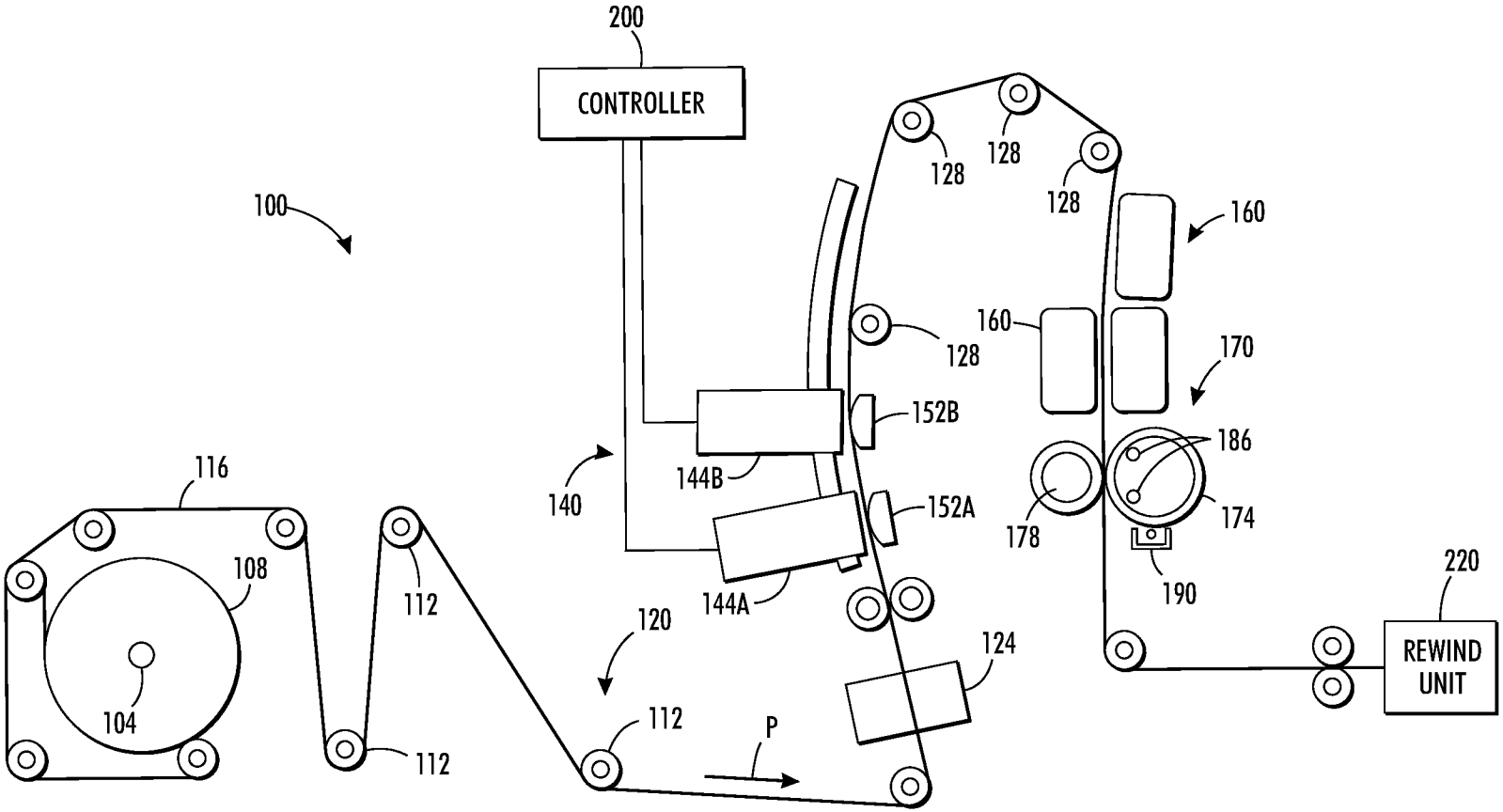
FIG. 1 is a schematic depiction of an inkjet printer.

For a general understanding of the environment for the system and method disclosed herein as well as the details for the system and method, reference is made to the drawings. In the drawings, like reference numerals have been used throughout to designate like elements.

As used herein the term "printer" refers to any device that is configured to produce images made with one or more colorants on print media. Common examples of printers include, but are not limited to, xerographic and inkjet printers. Various printer embodiments use one or more marking materials, such as ink or toner, to form printed images in various patterns. An image receiving surface refers to any surface that receives a marking material, such as an imaging drum, imaging belt, or various print media including paper. As used herein, the term "marking material" refers to a substance deposited on a substrate to form a printed image on the substrate. The marking material can be ink, for example aqueous or phase change inks, xerographic developer or toner particles, or any other substance used for forming an image on a substrate. The term "substrate" refers to a print medium, such as paper, that holds printed images. In some embodiments, the printer is a digital printer. Digital printers enable an operator to design and modify image data to alter the image printed on the substrate easily using, for example, commercially available image editing software.

A continuous feed or "web" printer produces images on a continuous web print substrate such as paper. In some configurations, continuous feed printers receive image substrate material from large, heavy rolls of paper that move through the printer continuously instead of as individually cut sheets. The paper rolls can typically be provided at a lower cost per printed page than pre-cut sheets. Each such roll provides an elongated supply of paper printing substrate in a defined width. Fan-fold or computer form web substrates may be used in some printers having feeders that engage sprocket holes in the edges of the substrate. After formation of the images on the media web, one or more cutting devices separate the web into individual sheets of various sizes. Some embodiments use continuous feed printing systems to print a large number of images in a timely and cost efficient manner.

As used herein, the term "magnetic ink" refers to an ink that includes a suspension of magnetic particles in a liquid or phase-change medium. Some magnetic inks include a suspension of particles, such as iron oxide, in an aqueous or organic based solvent. Another type of magnetic ink is a phase-change magnetic ink. The phase-change magnetic ink is substantially solid at room temperature and includes magnetic particles that are distributed throughout the solid phase-change ink. When heated to a predetermined melting temperature, the phase change ink melts into a liquid with the magnetic particles suspended in the liquid ink. An inkjet printer ejects liquid drops of the phase-change magnetic ink onto an image receiving surface and the phase-change ink cools and returns to the solid state.

FIG. 1 is a simplified schematic view of the direct-to-sheet, continuous-media, phase-change inkjet printer 100, that is configured to print images using both magnetic and non-magnetic inks. A media supply and handling system is configured to supply a long (i.e., substantially continuous) web of media 116 of "substrate" (paper, plastic, or other printable material) from a media source, such as spool of media 108 mounted on a web roller 104. One common type of substrate is uncoated paper. The uncoated paper includes a matrix of cellulose fibers. The uncoated paper is porous and can absorb liquids, including liquid inks, which are printed on the paper. The printer 100 includes a feed roller 104, media conditioner 120, printing station or print zone 140, and rewind unit 220. The media source 108 has a width that substantially covers the width of the rollers 112 and 128 over which the media travels through the printer. The rewind unit 220 is configured to wind the web onto a takeup roller for removal from the printer and subsequent processing.

The media can be unwound from the source 108 as needed and propelled by a variety of motors, not shown, rotating one or more rollers. The media conditioner 120 includes rollers 112 and a pre-heater 124. The rollers 112 control the tension of the unwinding media 116 as the media 116 moves along a path through the printer 100. In alternative embodiments the media can be transported along the path in cut sheet form, in which case the media supply and handling system can include any suitable device or structure that enables the transport of cut media sheets along an expected path through the imaging device. The pre-heater 124 brings the web 116 to an initial predetermined temperature that is selected for desired image characteristics corresponding to the type of media being printed as well as the type, colors, and number of inks being used. The pre-heater 124 can use contact, radiant, conductive, or convective heat to bring the media to a target preheat temperature, which, in one practical embodiment, is in a range of about 30° C. to about 70° C.

The media 116 are transported through a print zone 140 that includes a series of printhead units 144A, 144B. Each printhead unit 144A, 144B effectively extends across the width of the media 116 and is able to place ink directly (i.e., without use of an intermediate or offset member) onto the moving media. Each of the printhead units 144A, 144B includes a plurality of printheads positioned in a staggered arrangement in the cross-process direction over the media web 116. In alternative embodiments, single printheads having a width sufficient to reach from about one edge of the media to about the other edge of the media are positioned relative to one another to register different color separations to form ink images across most of the width of the media in proper registration to achieve a predetermined dots per inch (dpi) resolution on the media.

Each of the printhead units 144A, 144B in the printer 100 can use "phase-change ink," by which is meant that the ink is substantially solid at room temperature and substantially liquid when heated to a phase change ink melting temperature for jetting onto the image receiving surface. The phase change ink melting temperature can be any temperature that is capable of melting solid phase change ink into liquid or molten form. In one embodiment, the phase change ink melting temperature is approximately 70° C. to 140° C.

In the configuration illustrated in FIG. 1, the printhead unit 144A ejects a non-magnetic black ink onto the media web 116 and the printhead unit 144B ejects a magnetic black ink onto the media web 116. In another embodiment, a printer includes multiple printhead units with the same configuration as printhead unit 144A that are configured to eject different colors of non-magnetic ink for multi-color printing. In still another embodiment, a printer includes printhead units that eject both magnetic and non-magnetic ink from the same printhead. In the print zone 140, the media web 116 passes the printhead unit 144A in the process direction P to receive non-magnetic ink prior to passing the printhead unit 144B to receive the magnetic ink. Another configuration of the print zone 140 arranges the printhead units to eject the magnetic ink onto the media web 116 prior to the non-magnetic ink being ejected onto the web 116.

The controller 200 of the printer receives velocity data from encoders mounted proximate to rollers positioned on either side of the print zone, that is, before and after the printhead units 144A, 144B in the process direction to compute the position of the web 116 as the web 116 moves past the printheads. The controller 200 uses these data to generate firing signals for actuating the inkjets in the printheads to enable the ink to be ejected with a reliable degree of accuracy for registration of magnetic and non-magnetic ink patterns to form single or multi-color images on the media. The inkjets actuated by the firing signals correspond to electronic image data processed by the controller 200. The electronic image data can be transmitted to the printer from a computer or other electronic device, generated by a scanner (not shown) that is a component of the printer, or otherwise electronically or optically generated and delivered to the controller 200 of the printer.

A backing member 152A and 152B is associated with each of printhead units 144A and 144B, respectively. The backing members 152A, 152B are typically in the form of a bar or roll, which is arranged substantially opposite the printhead 144A, 144B on the back side of the media 116. Each backing member 152A, 152B is used to position the media 116 at a predetermined distance from the printhead 144A, 144B opposite the backing member. Each backing member 152A, 152B can be configured to emit thermal energy to heat or maintain the media 116 to or at a predetermined temperature. In one practical embodiment, the backing members 152A, 152B emit thermal energy in a range of about 40° C. to about 60° C. The backing members 152A, 152B can be controlled individually or collectively. The pre-heater 124, the printheads 144A and 144B, backing members 152A and 152B (if heated), as well as the surrounding air combine to maintain the media 116 along the portion of the path through the print zone 140 in a predetermined temperature range of about 40° C. to 70° C.

As the partially-imaged media web 116 moves to receive inks of various colors from the printheads in the print zone 140, the printer 100 maintains the temperature of the media web 116 within a predetermined temperature range. The printheads in the printhead unit 144A eject a phase-change ink at a temperature that is typically significantly higher than the temperature of the media web 116. Consequently, the ink heats the media. Therefore, other temperature regulating devices can be employed to maintain the media temperature within a predetermined range. For example, the air temperature and air flow rate behind and in front of the media may also impact the media temperature. Accordingly, air blowers or fans can be utilized to facilitate control of the media temperature. Thus, the printer 100 maintains the temperature of the media web 116 within an appropriate range for the jetting of all inks from the printheads of the print zone 140. Temperature sensors (not shown) can be positioned along this portion of the media path to enable regulation of the media temperature.

Following the print zone 140 along the media path, the media web 116 moves over guide rollers 128 to one or more "mid-heaters" 160. A mid-heater 160 can use contact, radiant, conductive, and/or convective heat to control a temperature of the media 116. The mid-heater 160 brings the phase-change ink placed on the media to a temperature suitable for desired properties when the ink on the media is sent through the spreader 170. In one embodiment, a useful range for a target temperature for the mid-heater is about 35° C. to about 80° C. The mid-heater 160 has the effect of equalizing the ink and substrate temperatures to within about 15° C. of each other. Lower ink temperature gives less line spread while higher ink temperature causes show-through (visibility of the image from the other side of the print).

Following the mid-heaters 160, a fixing assembly 170 is configured to apply heat and/or pressure to the media to fix the images to the media. The fixing assembly 170 includes any suitable device or apparatus for fixing images to the media 116 including heated or unheated pressure rollers, radiant heaters, heat lamps, and the like. In the embodiment of FIG. 1, the fixing assembly includes a "spreader" 170, which applies a predetermined pressure, and in some implementations, heat, to the media 116. The function of the spreader 170 is to take droplets, strings of droplets, or lines of ink on web 116 and smear the ink by pressure and, in some systems, heat, so that spaces between adjacent drops are filled and image solids become uniform. In addition to spreading the ink, the spreader 170 also improves image permanence by increasing ink layer cohesion and/or increasing the ink-web adhesion. The spreader 170 includes rollers, such as image-side roller 174 and pressure roller 178, to apply heat and pressure to the media. Either roller can include heat elements, such as heating elements 186, to bring the web 116 to a temperature in a range from about 35° C. to about 80° C. In alternative embodiments, the fixing assembly can be configured to spread the ink using non-contact heating (without pressure) of the media after the print zone. Such a non-contact fixing assembly uses any suitable type of heater to heat the media to a desired temperature, such as a radiant heater, UV heating lamps, and the like.

In one practical embodiment, the roller temperature in spreader 170 is maintained at an optimum temperature that depends on the properties of the ink such as 55° C.; generally, a lower roller temperature gives less line spread while a higher temperature causes imperfections in the gloss. Roller temperatures that are too high may cause ink to offset to the roll. In one practical embodiment, the nip pressure is set in a range of about 500 to about 2000 psi/side. Lower nip pressure gives less line spread while higher pressure may increase wear on the pressure roller.

The spreader 170 also includes a cleaning/oiling station 190 associated with image-side roller 174. The station 190 cleans and/or applies a layer of some release agent or other material to the roller surface. The release agent material can be an amino silicone oil having viscosity of about 10-200 centipoises. Only small amounts of oil are required and the oil carried by the media is only about 1-10 mg per A4 size page. In one embodiment, the mid-heater 160 and spreader 170 can be combined into a single unit, with their respective functions occurring relative to the same portion of media simultaneously. In another embodiment the media is maintained at a high temperature as it is printed to enable spreading of the ink.

Following passage through the media path, the printed media can be wound onto a roller for removal from the system. A rewind unit 220 winds the printed media web onto a takeup roller for removal from the printer 100 and subsequent processing. Alternatively, the media can be directed to other processing stations that perform tasks such as cutting, binding, collating, and/or stapling the media or the like.

Operation and control of the various subsystems, components and functions of the printer 100 are performed with the aid of the controller 200. The controller 200 can be implemented with general or specialized programmable processors that execute programmed instructions. The instructions and data required to perform the programmed functions are stored in memory associated with the processors or controllers. The processors, their memories, and interface circuitry configure the controllers and/or print engine to perform the functions described above and the processes described below. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits.

Figure 2:
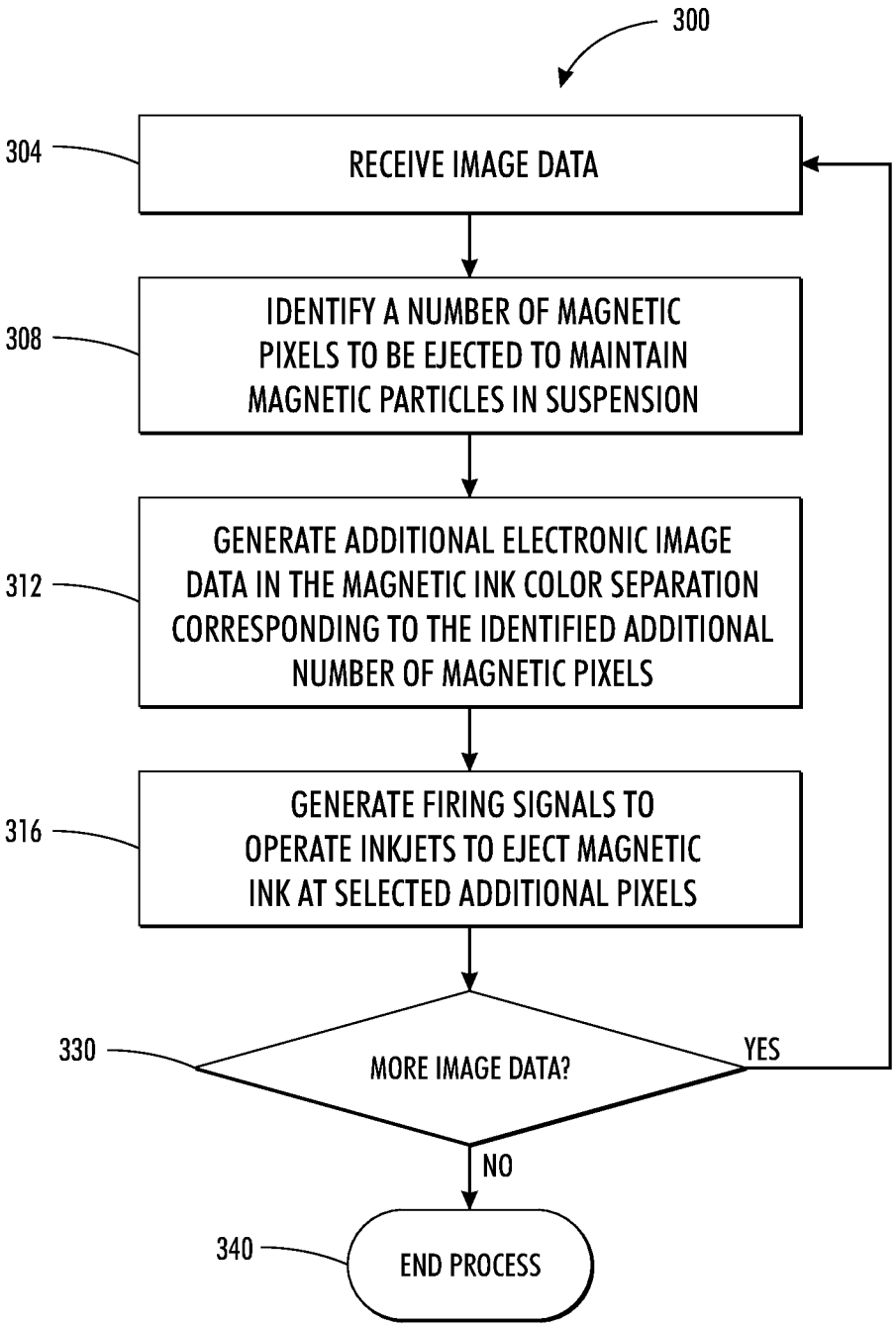
FIG. 2 is a block diagram of a process for printing magnetic ink images.

FIG. 2 depicts a process 300 for operating a printer to maintain magnetic particles in suspension in the printhead. The process 300 is described in conjunction with the printer 100 of FIG. 1 for illustrative purposes. While process 300 is described with reference to the continuous media printer 100, other printing devices, including cut-sheet media printers, can be configured to operate and perform the process 300. The process 300 refers to a controller, such as the controller 200 described above, executing programmed instructions stored in a memory operatively connected to the controller to cause the controller to operate one or more components of the printer to perform the specified function or action described in the process.

In the process 300, the controller receives electronic image data corresponding to an image to be printed (block 304). The electronic image data can be received from a computer or other electronic device operatively connected to the printer, from a scanner that is a component of the printer, or otherwise electronically or optically generated and delivered to the controller. The electronic image data includes a number of black ink pixels and a number of magnetic ink pixels. The electronic image data can also include a number of pixels to be printed in various different colors.

The controller then identifies a number of magnetic ink pixels to be ejected to maintain the magnetic particles in the ink reservoir in suspension (block 308). Because ink images corresponding to electronic image data may include only a small number of magnetic ink pixels, the magnetic ink within a printhead ejecting magnetic ink may experience insufficient flow in the printhead to keep the magnetic particles in suspension within the ink. By increasing the number of magnetic pixels printed by the printhead, process 300 operates the printhead ejecting magnetic ink in a manner that increases ink flow in the printhead to help the magnetic particles in the ink better remain in suspension. In one embodiment, the number of magnetic ink pixels to be printed in an ink image is the number of pixels required to print at the magnetic printhead resolution a predetermined percentage of the area of the media to be printed. In one embodiment, this number is the number of magnetic ink pixels required to cover an area that is approximately 1.8 percent of the area to be printed on the media. Other percentages can be used in other embodiments to address different viscosities and other properties of the magnetic ink, printhead configurations, printer operational parameters, the printing speed, the size of the reservoir in which the ink is stored, and other aspects affecting the suspension of magnetic particles in the liquid ink. In this embodiment, the number of magnetic ink pixels in the electronic image data is then subtracted from the predetermined number of pixels to identify an additional number of magnetic ink pixels needed to help maintain magnetic pixels in suspension in the magnetic ink. In other embodiments, a predetermined percentage of a number of pixels in the electronic image data, either overall or of one or more particular color separations, can be used to identify the number of additional magnetic ink pixels needed to help maintain the magnetic particles in suspension.

The controller then generates additional electronic image data in the magnetic ink color separation that corresponds to the identified number of additional magnetic pixels (block 312). These electronic image data are positioned in the magnetic ink color separation at locations corresponding to areas in other color separations where ink of the same color as the magnetic ink is to be printed. For example, if the magnetic ink is black ink, the image data for the additional magnetic ink pixels are positioned in the magnetic ink color separation in areas where black ink pixels are to be printed. Thus, the presence of the additional magnetic ink pixels is camouflaged by the non-magnetic ink of the same color. These additional magnetic ink pixels are positioned in the area of the magnetic ink color separation that corresponds to the area in another non-magnetic ink color separation with reference to some stochastic process. These additional magnetic ink pixels can be in addition to the non-magnetic ink pixels or, in some embodiments, can be substituted for some of the non-magnetic ink pixels. In this latter embodiment, the electronic image data in the non-magnetic ink color separation are deleted to prevent the printing of the non-magnetic ink pixels. The stochastic process used by the controller can operate with reference to a predetermined limit for magnetic ink pixels within a predetermined area size. The controller can also be programmed not to position the image data for the additional magnetic ink pixels within an area of the magnetic ink color separation corresponding to an area of the print media intended to be read by a MICR reader. This operation is performed to prevent the additional magnetic ink pixels from interfering with an accurate reading of the indicia corresponding to the electronic image data.

Once the electronic image data for the additional magnetic ink pixels are positioned in the magnetic ink color separation, the controller generates firing signals that operate the inkjets in the printheads of the printer (block 316). The firing signals corresponding to the magnetic ink color separation operate the inkjets to eject magnetic ink at positions other than the positions corresponding to the electronic image data first received for the magnetic ink color separation. The ejection of the magnetic ink drops, which includes the magnetic ink drops for the additional magnetic ink pixels added to the magnetic ink color separation, helps produce enough flow in the magnetic ink within the printhead ejecting magnetic ink drops to keep the magnetic particles in suspension. The controller then determines if more electronic image data are ready to be received (block 330), and, if additional electronic image data are ready to be received and processed, the process continues (block 304). Otherwise, the process terminates (block 340).

Figure 3:
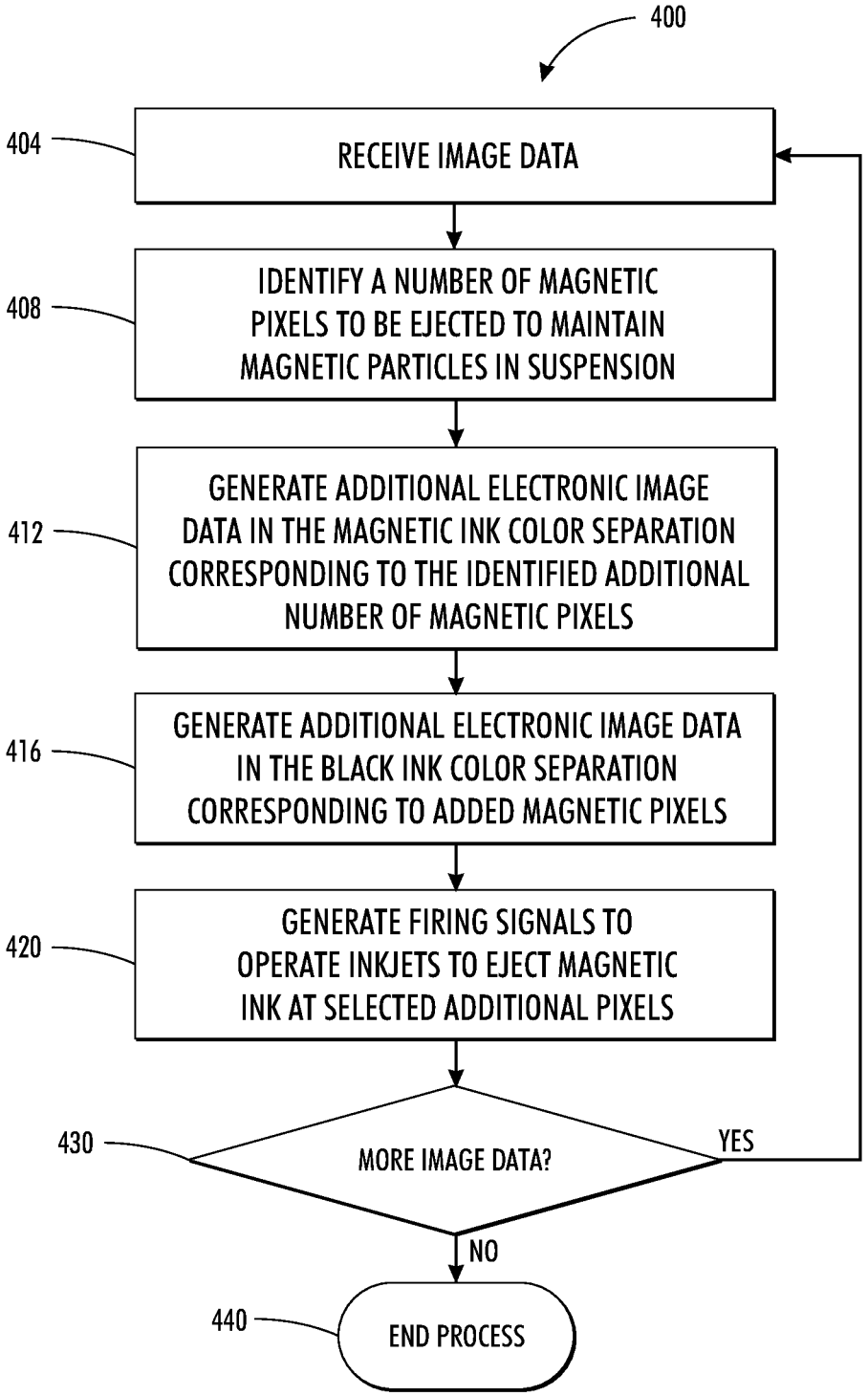
FIG. 3 is a block diagram for another process for printing magnetic ink images.

Another process 400 for operating a magnetic ink printhead to maintain magnetic particles in suspension is shown in FIG. 3. In the process 400, the controller receives electronic image data corresponding to an image to be printed (block 404). The electronic image data can be received from a computer or other electronic device operatively connected to the printer, from a scanner that is a component of the printer, or otherwise electronically or optically generated and delivered to the controller. The electronic image data includes a number of black ink pixels and a number of magnetic ink pixels. The electronic image data can also include a number of pixels to be printed in various different colors.

The controller then identifies a number of magnetic ink pixels to be ejected to maintain the magnetic particles in the ink reservoir in suspension (block 408). Because ink images corresponding to electronic image data may include only a small number of magnetic ink pixels, the magnetic ink within a printhead ejecting magnetic ink may experience insufficient flow in the printhead to keep the magnetic particles in suspension within the ink. As above, by increasing the number of magnetic pixels printed by the printhead, process 400 operates the printhead ejecting magnetic ink in a manner that increases ink flow in the printhead to help the magnetic particles in the ink better remain in suspension. In one embodiment, the number of magnetic ink pixels to be printed in an ink image is the number of pixels required to print at the magnetic printhead resolution a predetermined percentage of the area of the media to be printed. In one embodiment, this number is the number of magnetic ink pixels required to cover an area that is approximately 1.8 percent of the area to be printed on the media. Other percentages can be used in other embodiments to address different viscosities and other properties of the magnetic ink, printhead configurations, printer operational parameters, the printing speed, the size of the reservoir in which the ink is stored, and other aspects affecting the suspension of magnetic particles in the liquid ink. In this embodiment, the number of magnetic ink pixels in the electronic image data is then subtracted from the predetermined number of pixels to identify an additional number of magnetic ink pixels needed to help maintain magnetic pixels in suspension in the magnetic ink. In other embodiments, a predetermined percentage of a number of pixels in the electronic image data, either overall or of one or more particular color separations, can be used to identify the number of additional magnetic ink pixels needed to help maintain the magnetic particles in suspension.

The controller then generates additional electronic image data in the magnetic ink color separation that corresponds to the identified number of additional magnetic pixels (block 412). These electronic image data are positioned in the magnetic ink color separation at locations corresponding to areas in other color separations where ink of the same color as the magnetic ink is to be printed. For example, if the magnetic ink is black ink, the image data for the additional magnetic ink pixels are positioned in the magnetic ink color separation in areas where black ink pixels are to be printed. Thus, the presence of the additional magnetic ink pixels is camouflaged by the non-magnetic ink of the same color. These additional magnetic ink pixels are positioned in the area of the magnetic ink color separation that corresponds to the area in another non-magnetic ink color separation with reference to some stochastic process. The stochastic process used by the controller can operate with reference to a predetermined limit for magnetic ink pixels within a predetermined area size. The controller can also be programmed not to position the image data for the additional magnetic ink pixels within an area of the magnetic ink color separation corresponding to an area of the print media intended to be read by a MICR reader. This operation is performed to prevent the additional magnetic ink pixels from interfering with an accurate reading of the indicia corresponding to the electronic image data.

In the process 400, additional non-magnetic ink pixels are generated to further camouflage the additional magnetic ink pixels printed when a difference in color between the magnetic ink and non-magnetic ink printed in the same area may be perceptible (block 416). To this end, additional electronic image data are generated and stored in one of the non-magnetic ink color separations. These additional image data are stored at locations in the non-magnetic ink color separation that correspond to the locations where the additional magnetic ink pixels were stored in the magnetic ink color separation. Since magnetic ink is most often black colored ink, the additional non-magnetic ink color pixels are stored in the black color separation; however, in other embodiments in which the magnetic ink is a color other than black, the non-magnetic ink used to camouflage the magnetic ink pixels can be a colored ink different from black ink.

Once the electronic image data for the additional magnetic ink pixels and the additional non-magnetic ink pixels, if any, are positioned in the magnetic ink color separation and the non-magnetic ink color separation, respectively, the controller generates firing signals that operate the magnetic inkjets in the printheads of the printer (block 420). The firing signals corresponding to the magnetic ink color separation operate the inkjets to eject magnetic ink at positions other than the positions corresponding to the electronic image data first received for the magnetic ink color separation and to eject additional pixels of the non-magnetic ink color not in the original electronic image data. The ejection of the magnetic ink drops, which includes the magnetic ink drops for the additional magnetic ink pixels added to the magnetic ink color separation, helps produce enough flow in the magnetic ink within the printhead ejecting magnetic ink drops to keep the magnetic particles in suspension and the additional non-magnetic ink pixels help cover those additional magnetic ink pixels. Finally, the controller determines if more electronic image data are ready to be received (block 430), and, if additional electronic image data are ready to be received and processed, the process continues (block 404). Otherwise, the process 400 terminates (block 440).

Although the above process has been described with reference to an inkjet printer printing magnetic ink pixels in locations where only black ink is to be printed, the reader should appreciate that the above process can be applied to other types of printing where marking material can degrade during periods of non-use. For example, the process can be applied to print pixels of color toner in a xerographic printer where only black toner is to be printed to cover the color toner with black toner and reduce degradation that occurs over time with stagnant toner particles. The process can be used in a printer using any type of marking material that has been stagnant for a predetermined period of time. The stagnant marking material can be printed in a position where the added marking material can be covered or camouflaged with other marking material to reduce degradation of stagnant marking material without compromising image quality.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. A printer comprising:

a first marking station configured to print a first marking material;

a second marking station configured to print a second marking material; and a controller operatively connected to the first and second marking stations, the controller being configured to receive image data corresponding to an image having at least one area in which only the second marking material is to be printed, to identify a number of pixels to be ejected from the first marking station to keep particles in the first marking material in the first marking station in suspension, to identify a difference between a number of pixels corresponding to the first marking material in the received image data and the identified number of pixels, to operate the first marking station to eject pixels of the first marking material corresponding to the identified difference in the at least one area in which only the second marking material is to be printed to reduce degradation of the first marking material stored in the printer, and to operate the second marking station to print the second marking material in the at least one area in which only the second marking material is to be printed.

2. The printer of claim 1 further comprising:

the first marking station being a first plurality of inkjets in a printhead configured to eject magnetic ink;

the second marking station being a second plurality of inkjets in another printhead configured to eject black ink; and the controller further configured to operate the first plurality of inkjets to eject the pixels of magnetic ink corresponding to the identified difference in the at least one area in which only the second marking material is to be printed to maintain magnetic particles in suspension within the magnetic ink stored in the printhead, and to operate the second plurality of inkjets to eject black ink in the at least one area in which only the second marking material is to be printed.

3. The printer of claim 2, the controller being configured to operate the first plurality of inkjets to eject pixels of magnetic ink corresponding to the identified difference as substitutes for at least some of the second marking material to be printed in the at least one area.

4. The printer of claim 2, the controller being configured to operate the first plurality of inkjets to eject pixels of magnetic ink corresponding to the identified difference in the at least one area in addition to the second marking material to be printed in the at least one area.

5. The printer of claim 2 wherein the magnetic ink is a phase change magnetic ink.

6. The printer of claim 1, the controller being further configured to identify the number of pixels to be ejected from the first marking station to keep particles in the first marking material in the first marking station in suspension with reference to a predetermined percentage of an area having a predetermined size on an image receiving surface.

7. The printer of claim 1 wherein the first plurality of inkjets and the second plurality of inkjets are in different printheads.

8. The printer of claim 1 wherein the first plurality of inkjets and the second plurality of inkjets are in one printhead.

* * * * *